US005542671A

United States Patent [19]

Stewart

[11] Patent Number: 5,542,671

[45] Date of Patent: Aug. 6, 1996

[54] METHOD FOR PLAYING GAME OF DICE

[76] Inventor: Walter M. Stewart, 8700 N. La Cholla Blvd., Tucson, Ariz. 85741

[21] Appl. No.: 221,921

[22] Filed: Mar. 2, 1994

[51] Int. Cl.[6] ..... A63F 9/04

[52] U.S. Cl. ..... 273/146

[58] Field of Search ..... 273/146, 274

[56] References Cited

U.S. PATENT DOCUMENTS

| | | | |
|---|---|---|---|
| 3,747,935 | 7/1973 | Engelbrecht | 273/146 |
| 4,247,114 | 1/1981 | Carroll | 273/146 |
| 4,312,508 | 1/1982 | Wood | 273/274 |
| 4,635,938 | 1/1987 | Gray | 273/274 |
| 5,133,559 | 7/1992 | Page | 273/274 |

*Primary Examiner*—Benjamin H. Layno

*Attorney, Agent, or Firm*—Ashen Golant & Lippman

[57] ABSTRACT

A casino game using three dice, one having the color red and the other two having bodies of white. The red die is rolled first followed by a roll of the two white dice. A better wins when the two white dice show a total number larger than the number on the red die and the total number on the white dice and the number on the red die are both odd or both even. Payoff ratios can be varied and various side bets, depending upon the outcome of the dice rolls may be arranged.

8 Claims, 1 Drawing Sheet

| ONE RED DIE ROLL | TWO WHITE DICE ROLLS WHICH ALLOWS THE BETTER TO WIN | NUMBER OF COMBINATIONS TO WIN | TWO WHITE DICE ROLLS WHICH ALLOWS THE CASINO TO WIN | NUMBER OF COMBINATIONS TO WIN |
|---|---|---|---|---|
| 1 | 3,5,7,9,11 | 18 | 2,4,6,8,10,12 | 18 |
| 2 | 4,6,8,10,12 | 17 | 2,3,5,7,9,11 | 19 |
| 3 | 5,7,9,11 | 16 | 2,3,4,6,8,10,12 | 20 |
| 4 | 6,8,10,12 | 14 | 2,3,4,5,7,9,11 | 22 |
| 5 | 7,9,11 | 12 | 2,3,4,5,6,8,10,12 | 24 |
| 6 | 8,10,12 | 9 | 2,3,4,5,6 7,9,11 | 27 |
| | TOTAL WINNING COMBINATIONS | 86 | TOTAL WINNING COMBINATIONS | 130 |

| ONE RED DIE ROLL | TWO WHITE DICE ROLLS WHICH ALLOWS THE BETTER TO WIN | NUMBER OF COMBINATIONS TO WIN | TWO WHITE DICE ROLLS WHICH ALLOWS THE CASINO TO WIN | NUMBER OF COMBINATIONS TO WIN |
|---|---|---|---|---|
| 1 | 3,5,7,9,11 | 18 | 2,4,6,8,10,12 | 18 |
| 2 | 4,6,8,10,12 | 17 | 2,3,5,7,9,11 | 19 |
| 3 | 5,7,9,11 | 16 | 2,3,4,6,8,10,12 | 20 |
| 4 | 6,8,10,12 | 14 | 2,3,4,5,7,9,11 | 22 |
| 5 | 7,9,11 | 12 | 2,3,4,5,6,8,10,12 | 24 |
| 6 | 8,10,12 | 9 | 2,3,4,5,6,7,9,11 | 27 |
| | TOTAL WINNING COMBINATIONS | 86 | TOTAL WINNING COMBINATIONS | 130 |

METHOD FOR PLAYING GAME OF DICE

BACKGROUND OF THE INVENTION

1. Field of the Invention

This invention relates generally to a game of dice and more particularly, to an improved dice game for use in casinos and which is an improvement on the game currently known as Craps.

2. Description of the Related Art

Craps is the name of a popular dice game,—a name known the world over. The Encyclopedia Britannica when explaining one version of the game states that generally, any number of people may play and each player in turn may, as the shooter, cast two matched dice in an attempt to roll a winning combination. Usually, before his or her first throw the shooter puts up a stake and other players bet against the shooter up to the amount of the stake. If the shooter wins when the dice are rolled, he or she may continue to shoot and bet again as much or as little as desired. Alternatively, the shooter may give up the dice. If the shooter loses, the other players win the amount they bet. The other players may also bet among themselves as to whether the shooter will win or lose in the next series of throws or whether certain numbers or combinations will appear.

As is almost universlly known, each die is a cube with each of the six faces bearing one of the numbers 1 through 6 with no two faces bearing the same number. The number is indicated by a series of dots except that the number "1" is indicated by one dot.

Generally, the rules of the game provide that the shooter using two dice will win if he or she rolls a 7 or 11 on the first roll. If the first roll results in a 2, 3 or 12, the shooter loses. Bets are then settled. If the shooter's first throw is 4, 5, 6, 8, 9 or 10, that number is the shooter's "point" and he or she continues to roll until either the same number appears again which results in a win, or the shooter throws a 7 and loses both his or her bet as well as the dice. Again, side bets may be laid with or against the shooter either before or after the shooter rolls a point.

The game of Craps is probably most well known in its version as a casino game. One of the popular Las Vegas, Nevada casinos describes the game a little differently from that explained in the Encyclopedia Britannica. Most importantly, all wagers are placed vis-a-vis the casino and also before the shooter rolls the dice. The types of wagers are somewhat varied and are described as follows: "pass line" is an even money bet. On the first roll the better wins on a natural 7 or 11 and loses on a 2, 3 or 12. Any other number is the "point" and the shooter must throw the point again before a 7 is rolled in order for a win to occur. "Don't pass line" is the opposite of the "pass line". The better loses on a natural 7 or an 11 on the first roll. The better wins on a 2 or 3 while the 12 is a tie with the casino. The better also loses after the first roll if the point is made. A better will win after the first roll if the roll is a 7 before the point is made. "Come bets" are made any time after the first roll when a shooter has a point to make. A better wins on a natural 7 or 11 and loses on 2, 3 or 12. Any number that comes up is a "come point" and must be thrown before a seven is thrown. "Don't come bets" are opposite of the "come bet" except that a first roll of 2 or 3 wins and a 12 is a tie. The better loses on a natural 7 or 11. Any other number thrown is the "come point" and the better loses if the come point is made before a seven is rolled. Under certain conditions, "free odds" are bets placed after a point is rolled on the first roll or a come point on a succeeding roll. The better takes the odds and wins if the point or come points are made before a 7 is rolled. The true payoff odds are two to one on a roll of 4 or 10, three to two on a roll of 5 or 9, six to five on a roll of 6 or 8. "Don't pass" or "Don't come" are bets in reverse. "Place bets" occur after a shooter rolls a point. The better may make a place bet on numbers 4, 5, 6, 8, 9 and 10. If the shooter rolls any one of those numbers before 7, the better wins the following payoffs: nine to five on a roll of 4 or 10, seven to five on a roll of 5 or 9 and seven to six on a roll of 6 or 8. "Field bets" are one roll bets. The better wins even money on 3, 4, 9, 10 and 11, two to one on a roll of 2 and three to one on a roll of 12. The better loses on 5, 6, 7 and 8. "Proposition bets" are also one roll bets. Two or twelve pays 31 to 1. Any crap (2, 3 and 12) pays 7 to 1, 3 and 11 pay 16 to 1. "Hard ways" betters win if the number comes up exactly as on the table and loses if the number comes up any other way or if a 7 is thrown. These one roll bets vary somewhat between casinos in their description and payoff odds.

"Craps" is widely known as the name of a dice game but the rules of play certainly are not widely known, simply because they require substantial memorization of numbers and their relationship, which is not consistent from one game to the next, and because the number of rolls and their win/lose outcome will vary as a function of the numbers being rolled.

BRIEF SUMMARY OF THE INVENTION

The inadequacies of the prior art have been resolved by the present invention.

The game disclosed herein comprises the steps of providing three dice where one of the dice is handled differently from the other two; providing a shooter; having the shooter roll the three dice; determining the number of spots on the one differently handled die; thereafter determining the combined total of the spots on the remaining two dice; and comparing the total of the spots of the remaining two dice and the spot or spots on the one differently handled die according to a predetermined array to determine whether the shooter or better wins or loses.

Accordingly, it is an object of the present invention to provide a method for playing a game of dice which is relatively simple, easy to play and consistent one game to the next. Another aspect of the invention is to provide a method for playing a game of dice which has a high entertainment value. Still another aim of the present invention is to provide a method for playing a game of dice which has a high rate of return to the casino.

A more complete understanding of the present invention and other objects, aspects, aims and advantages thereof, will be gained from a consideration of the following description of the preferred embodiment taken in conjunction with the drawing.

DESCRIPTION OF THE PREFERRED EMBODIMENT

Figures 1, 2:
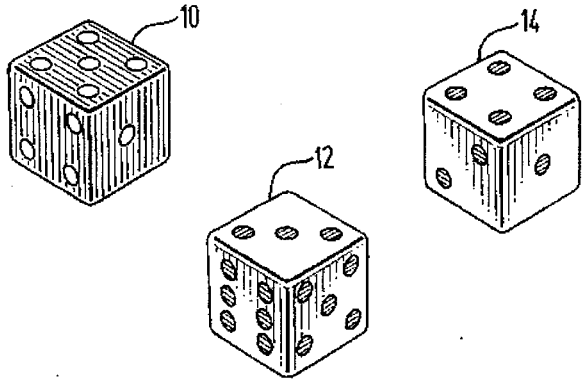
FIG. 1 is an array table showing the relationship between the number appearing on one specific die and what is needed by a shooter/better and the casino to win based on the total number showing on the other two dice.
FIG. 2 is a perspective view illustrating one color die and two white dice.

While the present invention is open to various modifications and alternative constructions, the preferred embodiment will be described herein in detail. It is to be understood, however, that there is no intention to limit the invention to the particular form disclosed. On the contrary, the intention is to cover all modifications, equivalences and alternative constructions falling within the spirit and scope of the invention as expressed in the appended claims.

The simplicity and entertainment value of the game may be appreciated by a consideration of how the inventive game is played. First, three dice are to be used with one die being handled differently from the other two. Preferably, the one die is of one color and the remaining two dice are of another color. For example here, the one die may be red with white spots and the other two dice may each have a white body with black spots. A shooter is provided and he or she rolls the three dice together or in sequence, the red die first and then the two white dice, for example. A win or lost decision is reached after the roll of the three dice. After each role the dice may pass to another shooter or may be held by the same shooter, depending upon the rules of the casino where the game is being played. This provides for a faster moving game than the prior art game of Craps since a roll of the three dice ends the game and it decides the outcome.

Returning to the process of play, after the shooter has rolled the three dice there is a determination of the number of spots on the red die, and a determination of the combined total of spots on the two white dice. Thereafter the total of spots on the two white dice are compared with the spot or spots on the one red die in accordance with a predetermined array as will be explained below.

It is to be understood that a casino may wish to have a time lapse between the roll of the one red die and the roll of the two white dice. This will permit betters to place bets on the three dice outcome knowing in advance the showing of the red die. Of course, from the casino's viewpoint, this lapse of time is for the purpose of increasing the dollar volume of bets per three dice role without slowing the game in any significant way.

A shooter/better will win when the following two events happen together. First, the two white dice show a combined number greater than the number shown on the red die. Second, both the white dice combined number and the red die number are either odd or even.

By way of example, if the red die which was rolled first shows a 2, the better will win if the two white dice total 4, 6, 8, 10 or 12, because each of these numbers is greater than 2 and each is an even number. On the other hand, if the red die shows a 3, the better will win only if the two white dice total 5, 7, 9 or 11, because each of these numbers is greater than 3 and odd.

Referring to FIG. 1 there is illustrated an array showing the six possible numbers produced by the red die and the corresponding numbers which must be produced by the white dice that will allow either the shooter/better or the casino to win.

FIG. 1 shows all of the possible combinations of numbers that can appear on the roll of the three dice and separates those combinations into two parts. One portion shows the manner in which the shooter/better can win and the other portion shows the manner in which the shooter/better will lose, or conversely when the casino will win.

Each die can only show one of six faces and its showing is independent of the showing of the other two dice. This gives the result that there are 216 possible different combinations, calculated by multiplying 6×6×6.

It is apparent from FIG. 1 that the number of ways for the shooter/better and the casino to win varies as a function of the number which is rolled on the red die. By way of an additional example, if the red die is rolled and a 5 appears, the shooter/better will win only if the two white dice are rolled and generate a number greater than 5 and that number is odd. That means the shooter will win if a 7, 9 or 11 is rolled on the white dice. Of 36 possible combinations, 7, 9 and 11 can be rolled in the following 12 ways: (3,4), (4,3), (5,2), (2,5), (1,6), (6,1), (4,5), (5,4), (6,3), (3,6), (5,6) and (6,5). FIG. 2 shows one of these winning combinations. There is illustrated a red die 10 showing five dots, a white die 12 showing three dots and another white die 14 showing four dots. In contrast, FIG. 1 shows that there are 24 ways for the casino to win. The casino will win if 2, 3, 4, 5, 6, 8, 10 or 12 is rolled because the numbers 2, 3, 4 and 5 are not greater than 5 and the numbers 6, 8, 10, 12 are not odd. The numbers 2, 3, 4, 5, 6, 8 and 10 and 12 may be rolled in the following 24 ways: (1,1), (1,2), (2,1), (3,1), (1,3), (2,2), (4,1), (1,4), (2,3), (3,2), (5,1), (1,5), (4,2), (2,4), (3,3), (6,2), (2,6), (5,3), (3,5), (4,4), (6,4), (4,6), (5,5) and (6,6).

The casino percentage therefor equals 24 minus 12 divided by 36 or 0.333 or 33.3%. This translates into a casino win of thirty-three cents per dollar bet on the roll of the white dice when the red die shows a 5 and the casino is paying even money, a ratio of one to one. Clearly, as disclosed by FIG. 1, the roll of the red die will produce one of six numbers with each having a different resultant casino percentage. The higher the number on the red die the greater the likelihood that the casino will win and the shooter/better will lose.

Another way to view FIG. 1 is to determine the casino's win per dollar bet for the game in its entirety. Using the same calculation as before, the answer is 20.4 cents per dollar bet. The calculation is 130 minus 86 divided by 216 which equals 0.204 or 20.4 cents. This assumes a casino payoff ratio of one to one. By comparison it is understood that comparable figures for Roulette is only 5.2 cents and for Craps the number is 1.4 cents.

It is noted that if the roll of the red die results in a "1", the casino and the shooter/better have an equal likelihood of winning. However, over the long term this circumstance will only occur only one sixth of the time. Despite this low frequency and the high casino advantage provided by the present invention, additional steps may be taken if the casino finds the roll of a "1" on the red die to be undesirable.

While the payoff ratio of one to one has been mentioned, that ratio can change to the casino's advantage, for example, by decreasing the payoff ratio. The converse is also true. However, increasing the payoff ratio while lowering the casino's advantage may increase the volume of play and the profit if the game attracts more betters. The payoff ratio can be altered without changing the basic rules of the game.

The payoff ratio may also be a hybrid. For example, the casino's payoff ratio might remain one to one when the red die shows a 1, 2, 3 or 4. However, the ratio may become three to two when the red die shows a 5 or 6. Obviously, these higher payoffs will make the game more alluring to the shooter and other betters. By computation similar to that shown previously for the one to one payoff, the introduction of a three to two payoff for a red die role of 5 or 6 will reduce the casino's average intake per dollar bet from about 20.4 cents to 15.5 cents; this is still ten times more than the intake from Craps and three times more than that offered by Roulette.

Another situation to note are betters who wish to bet against the shooter. Stated in another way, these are betters who wish to bet that the casino will win. Such betters are sometimes referred to as "wrong-way" betters and obviously with the relationship set forth in FIG. 1, a casino would not wish to permit a better to enjoy the same favorable percentages as the casino enjoys. To turn the percentages around for such a better the casino can introduce a standoff feature.

Generally, developing a standoff feature is not simple. The problem is that except for a red die roll of 1, the number of ways of winning for the casino increases as the red die number increases. To allow a wrong way better to also achieve such a ratio is of course not acceptable to a casino. Thus, it would be desirable to allow a wrong way better to win but not as frequently as the casino itself will win. It has been found that a solution to this problem is to provide a standoff roll in which the sum of the three dice is a number greater than 9. Such a role will have no effect on the better or the casino. To measure the affect on the numbers reference is made to FIG. 1 and the line showing a red die roll of 4. The standoff rule of greater than 9 (for all three dice) would eliminate the numbers 7, 9 and 11 from the column for the casino thereby reducing the number of ways to win from 22 to 10. Under this standoff criteria the casino has a 13.4 cents per dollar bet advantage with a payoff ratio of one to one against a wrong way better. This is calculated by subtracting 57 from 86 and dividing by 216.

Beside the play which has already been discussed, with a properly designed table, other players than the shooter can place a variety of side bets based on the showing of either the red die, the two white dice, or all three dice. Calculations of odds and casino payoffs can be made for an expanded number of side bets over those offered by the present game of Craps. For example, if the red die shows a 5, a side bet may be placed that the shooter will win by throwing a 7 with the two white dice. Should this occur the casino may decide to pay off at a ratio of five to one. In another situation, if the red die shows a 3 and the two white dice show a combined total of 7, the result is a payoff win of one to one for all betters who bet to win. But if this 7 total is a (3, 4) or (4, 3) then (together with the red die 3) the three dice contain a pair so a better who placed his bet on a "win-pair" location on the table would win with a casino payoff of three to one. In a like manner a better might bet on "win-odd". He too could enjoy a three to one payoff. These types of bets, and there are others, have a casino retention of 20 to 25 cents or higher per dollar bet.

It is to be understood that the game may be played with three dice of the same color which might require two rolls of the dice. First, the shooter would roll one die, the number being displayed after the roll and then the die is removed from the table. Thereafter, the remaining two dice can be rolled to determine the win/loss outcome. The game may also be played with the three dice shaken and rolled together. This would require only one roll, however, one of the three dice must be distinguished from the other two such as by color, shape or size. The game could also be played by reversing the sequence of dice rolls, that is, rolling two dice first and then a single die. Or, the game could be played using a combination of two or more of the schemes already discussed.

I claim:

1. A process for playing a game of chance comprising the steps of:

providing three dice where one of the dice is differentiated from the other two;

providing a shooter;

having the shooter roll the three dice;

reading the number of spots on the said one differentiated die;

determining whether the number of spots on said one differentiated die is odd or even;

reading the number of spots on said other two dice;

determining whether the total number of spots on said other two dice is odd or even;

deciding, according to a predetermined array, that a better wins only when the total number of spots on said other two dice is greater than the number of spots on said one differentiated die and that both the total number of spots on said other two dice and the number of spots on said one differentiated die are either all odd or all even.

2. A process is claimed in claim 1 including the steps of:

rolling said one die first; and thereafter, rolling said other two dice.

3. A process as claimed in claim 2 including the step of:

allowing a time lapse after the roll of the first die to provide for bets to be placed.

4. A process as claimed in claim 1 wherein:

the array allows a better a total of 86 ways of winning and 130 ways of losing.

5. A process as claimed in claim 1 wherein: when the better wins, the payoff ratio is 1 to 1.

6. A process as claimed in claim 1 including the steps of:

said array is divided into two portions, a better-win portion and a casino-win portion;

allowing a better to place a bet according to the casino-win portion; and modifying said array to provide that said better will win only when the additional requirement, the total spots on all three dice is 9 or less, is also met.

7. A process as claimed in claim 11 including the step of:

placing side bets on the event that the dice exhibit a specific relationship.

8. A process as claimed in claim 1 wherein:

said one die is a different color from said other two dice.

* * * * *